US007654699B2

(12) United States Patent
Chang et al.

(10) Patent No.: US 7,654,699 B2
(45) Date of Patent: Feb. 2, 2010

(54) LED LAMP HAVING HEAT DISSIPATION STRUCTURE

(75) Inventors: Su-Chi Chang, Miao-Li Hsien (TW); Ying-Chieh Lu, Miao-Li Hsien (TW); Ping-Yu Chen, Miao-Li Hsien (TW); Shiao-Wen Lu, Miao-Li Hsien (TW); Wen-Jang Jiang, Miao-Li Hsien (TW); Hung-Kuang Hsu, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 7 days.

(21) Appl. No.: 11/959,296

(22) Filed: Dec. 18, 2007

(65) Prior Publication Data

US 2009/0080205 A1 Mar. 26, 2009

(30) Foreign Application Priority Data

Sep. 21, 2007 (CN) ..... 2007 1 0201818

(51) Int. Cl.
*F21V 29/00* (2006.01)

(52) U.S. Cl. ..... 362/294; 362/373

(58) Field of Classification Search ..... 362/218, 362/264, 294, 345, 373, 800
See application file for complete search history.

(56) References Cited

U.S. PATENT DOCUMENTS 6,220,722 B1 * 4/2001 Begemann ..... 362/231
6,793,374 B2 * 9/2004 Begemann ..... 362/294
6,918,762 B2 * 7/2005 Gill et al. ..... 433/29
7,434,964 B1 * 10/2008 Zheng et al. ..... 362/294
7,513,653 B1 * 4/2009 Liu et al. ..... 362/294
2005/0174780 A1 * 8/2005 Park ..... 362/294
2007/0279862 A1 * 12/2007 Li ..... 361/692
2007/0285926 A1 * 12/2007 Maxik ..... 362/294
2008/0002410 A1 * 1/2008 Burton et al. ..... 362/294
2008/0316755 A1 * 12/2008 Zheng et al. ..... 362/373

FOREIGN PATENT DOCUMENTS

TW 200900629 A 1/2009

* cited by examiner

*Primary Examiner*—Jacob Y Choi
(74) *Attorney, Agent, or Firm*—Clifford O. Chi

(57) ABSTRACT

An LED lamp for lighting purpose includes a lamp base, a heat sink, a plurality of LED modules and a blower. The lamp base encloses an inner space and defines a plurality of vents therein. The vents communicate the inner space with a surrounding atmosphere. The heat sink comprises a cylinder at a center thereof. The cylinder has a through hole therein, which communicates with the inner space and vents of the lamp base and cooperates therewith to form an air passage. The LED modules are attached to a periphery of the heat sink. The blower generates an airflow circulating through the air passage to thereby dissipate heat generated by the LED modules.

19 Claims, 5 Drawing Sheets

LED LAMP HAVING HEAT DISSIPATION STRUCTURE

BACKGROUND OF THE INVENTION

1. Field of the Invention

The present invention relates to an LED lamp, and particularly to an LED lamp having a heat dissipation structure for dissipating heat from LEDs thereof.

2. Description of Related Art

An LED lamp is a type of solid state lighting that utilizes light-emitting diodes (LEDs) as a source of illumination. An LED is a device for transferring electricity to light by using a theory that, if a current is made to flow in a forward direction in a junction comprising two different semiconductors, electrons and cavities are coupled at the junction region to generate a light beam. The LED has an advantage in that it is resistant to shock, and has an almost eternal lifetime under a specific condition; thus, the LED lamp is intended to be a cost-effective yet high quality replacement for incandescent and fluorescent lamps.

An LED lamp generally requires a plurality of LEDs, and most of the LEDs are driven at the same time, which results in a quick rise in temperature of the LED lamp. Since generally the LED lamp does not have a heat dissipation device with a good heat dissipating efficiency, operation of the LED lamp has a problem of instability because of the rapid increase of heat. Consequently, the light from the LED lamp often flickers, which degrades the quality of the illumination. Furthermore, the LED lamp is used in a high heat state for a long time and the life time thereof is consequently shortened.

What is needed, therefore, is an LED lamp which has a heat dissipation structure with a great heat-dissipation capability.

SUMMARY OF THE INVENTION

An LED lamp for lighting purpose includes a lamp base, a heat sink, a plurality of LED modules and a blower. The lamp base defines a plurality of vents therein. The heat sink comprises a cylinder at a centre thereof. The cylinder has a through hole therein, which communicates with an inner space and the vents of the lamp base and cooperates with the inner space and vents to form an air passage. The LED modules are attached to a periphery of the heat sink. The blower generates an airflow circulating through the air passage thereby to dissipate heat generated by the LED modules.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiment. Moreover, in the drawings, like reference numerals designate corresponding parts throughout the several views.

DETAILED DESCRIPTION OF THE INVENTION

Figure 1:
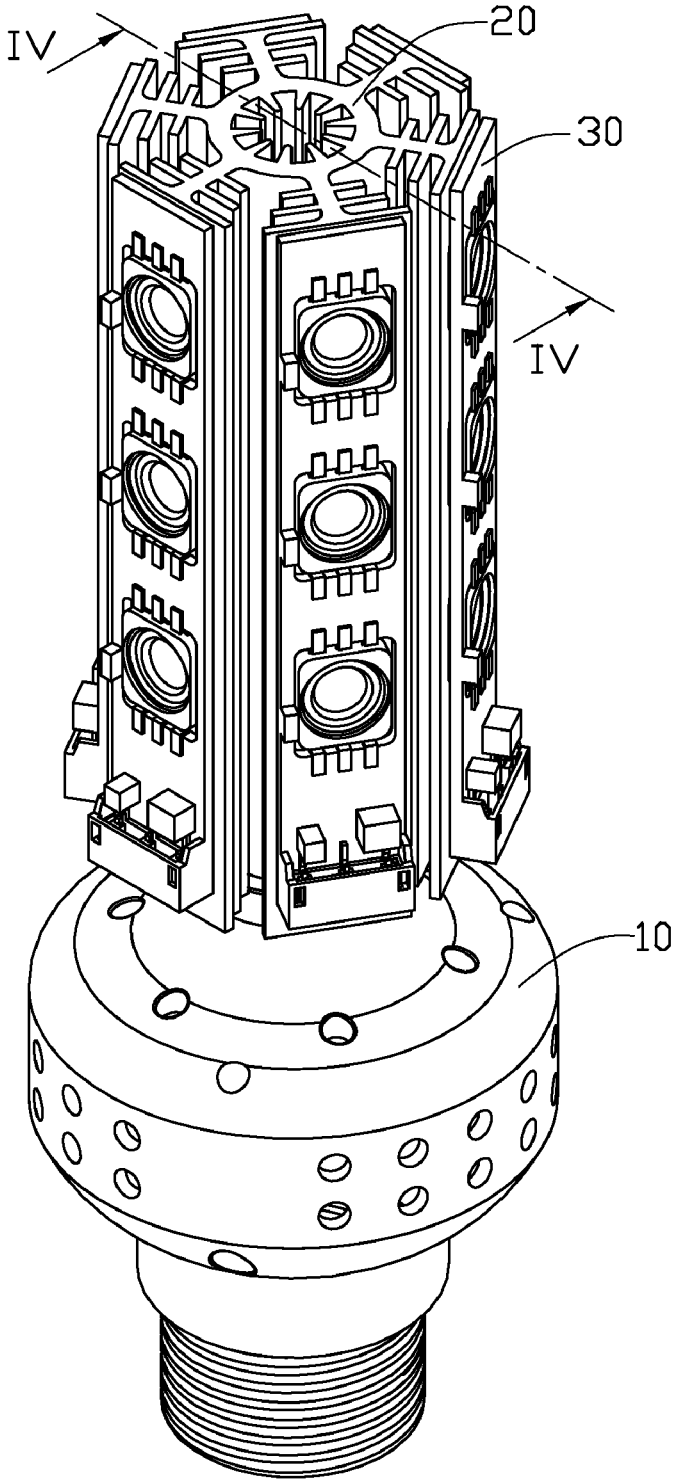
FIG. 1 is an isometric, assembled view of an LED lamp in accordance with a first preferred embodiment of the present invention.
Figure 2:
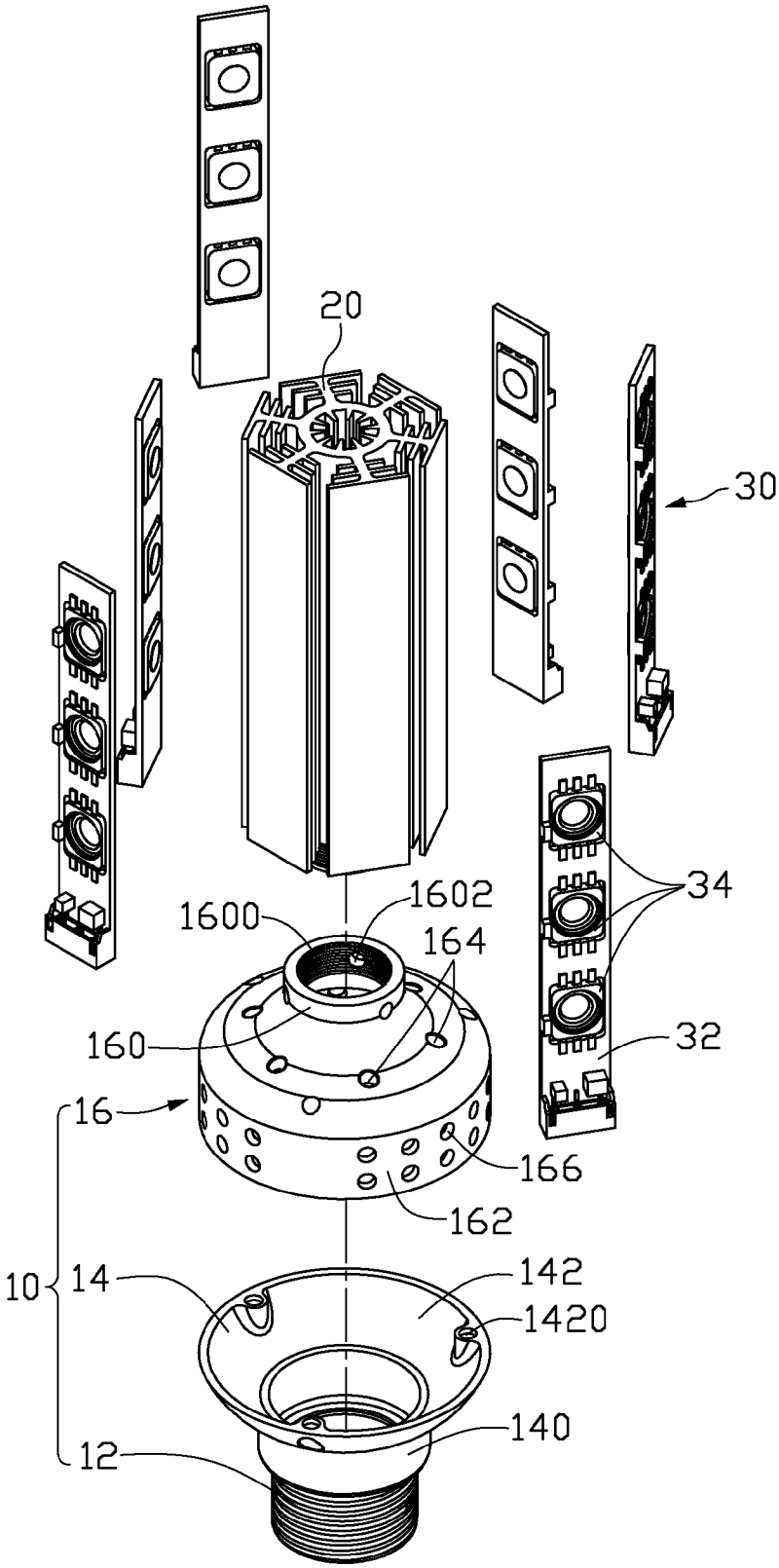
FIG. 2 is an exploded view of FIG. 1.

Referring to FIGS. 1-2, an LED lamp in accordance with a preferred embodiment of the present invention comprises a lamp base 10, a heat sink 20 coupled to the lamp base 10, a plurality of LED modules 30 thermally attached to a periphery of the heat sink 20 and a blower 40 (FIG. 4) mounted in the lamp base 10.

The lamp base 10 comprises a lamp holder 12, a first cover 14 connecting with the lamp holder 12 and a second cover 16 facing to and engaging with the first cover 12. The lamp holder 12 is provided with screw threads formed on a periphery thereof and has a standard configuration for fitting in a standard lamp socket. The first cover 14 comprises an annular joining portion 140 coupled with the lamp holder 12 and a first bowl-shaped body 142 extending upwardly from an upper edge of the joining portion 140. The first bowl-shaped body 142 has a caliber increasing gradually from a bottom to a top thereof. Three fixing orifices 1420 are evenly defined in an upper rim of the first bowl-shaped body 142. The three fixing orifices 1420 extend vertically through the first bowl-shaped body 142 for allowing screws (not shown) to extend therethrough to screw into the second cover 16, thereby fastening the first and second covers 14, 16 together.

The second cover 16 comprises an annular engaging portion 160 at a top thereof and a second bowl-shaped body 162 extending downwardly form a lower edge of the engaging portion 160. The engaging portion 160 has a diameter smaller than that of the joining portion 140 of the first cover 14 and forms screw threads 1600 in an inner wall thereof for engaging with the heat sink 20. Three through orifices 1602 are evenly and radially defined in the engaging portion 160. An upper portion of the second bowl-shaped body 162 has a caliber increasing gradually from a top to a bottom thereof and defines a plurality of leading orifices 164 therein for allowing lead wires (not shown) to extend therethrough to electrically connect the LED modules 30 with a rectifier circuit (not shown) and an electronic ballast (not shown) received in the lamp base 10. A lower portion of the bowl-shaped body 162, which has a constant caliber is substantially tube-shaped and symmetrically defines a plurality of vents 166. The vents 166 are provided for allowing ambient air to flow into an inner space enclosed by the first and second covers 14, 16 and circulate through the LED lamp. Three engaging orifices (not shown) corresponding to the fixing orifices 1420 of the first cover 14 are symmetrically defined in the second bowl-shaped body 162 and adjacent to a lower rim of the second bowl-shaped body 162. The three engaging orifices are used for engaging with the screws extending through the fixing orifices 1420 of the first cover 14 to couple the first cover 14 and the second cover 16 together. The first and second covers 14, 16 cooperatively form an enclosure with a space therein. The rectifier circuit and electronic ballast (not shown) for the LED modules 30 can be accommodated at a bottom of the enclosure namely a bottom of the first cover 12.

Figure 3:
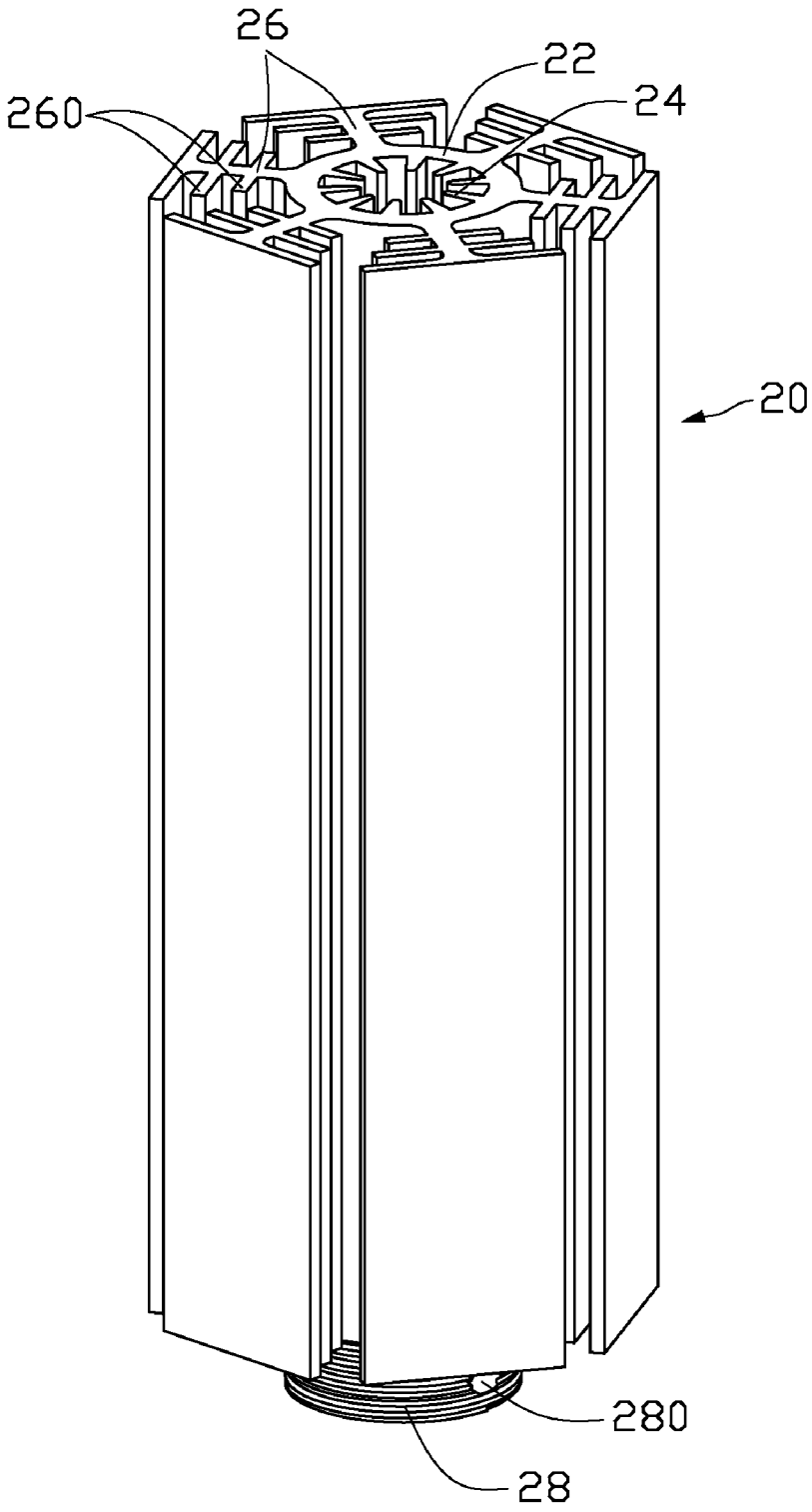
FIG. 3 is an enlarged view of a heat sink of the LED lamp of FIG. 1.

As shown in FIG. 3, the heat sink 20 is integrally formed of a material with good heat conductivity such as aluminum or copper. In the preferred embodiment, the heat sink 20 is formed by aluminum extrusion. The heat sink 20 has an elongated cylinder 22 at a center thereof. The cylinder 22 defines a through hole (not labeled) therein. The cylinder 22 has a plurality of first fins 24 extending inwardly from an inner wall thereof into the through hole. The first fins 24 are centrosymmetric relative to a central axis of the cylinder 22 and each have a thickness decreasing inwardly. The heat sink 20 has a plurality of conducting arms 26 extending outwardly from an outer wall of the cylinder 22. The conducting arms 26 are identical to each other and centrosymmetric relative to the central axis of the cylinder 22. The number of the conducting arms 26 is consistent with that of the LED modules 30 and can be different in different embodiments. In this embodiment, the numbers of the conducting arms 26 and the LED modules 30 are both six. A plurality pairs of second fins 260 are formed on two opposite lateral sides of the conducting arms 26. Each pair of the second fins 260 extend oppositely and perpendicularly from two lateral sides of each of the conducting arms 26 and are symmetrical to each other relative to the corresponding conducting arm 26. The second fins 260 at a lateral side of each of the conducting arms 26 increase in length outwardly from the cylinder 22 to a distal end of the corresponding conducting arm 26. Each distal end of the conducting arms 26 terminates at an inner face of an outmost second fin 260. An outer face of each outmost second fin 260 is flat and used for thermally contacting with one of the LED modules 30. In addition, to facilitate airflow in the through hole of the cylinder 22, a ratio of a length to a diameter of the cylinder 22 is in a range from 5:1 to 10:1. In this embodiment of the present invention, the length to diameter ratio of the cylinder 22 is 10:1.

An annular fixing part 28 extends downwardly and vertically from a bottom edge of the cylinder 22 and forms screw thread (not labeled) thereon for screwing into the engaging portion 160 of the second cover 16 to mount the heat sink 20 on the lamp base 10. The fixing part 28 symmetrically defines three through orifices 280 therein corresponding to the through orifices 1602 of the engaging portion 160 of the second cover 16. The heat sink 20 and the lamp base 10 can be locked together by three bolts (not shown) inserting into the corresponding through orifices 1602, 280 when the fixing part 28 of the heat sink 20 is received in the engaging portion 160 of the second cover 16.

Also referring to FIG. 2, the LED modules 30 each comprise an elongated printed circuit board 32 with a size slightly smaller than that of the outmost second fin 260 of the heat sink 20. A plurality of LED components 34 are mounted in a line on each of the printed circuit boards 32 along a length thereof.

Figure 4:
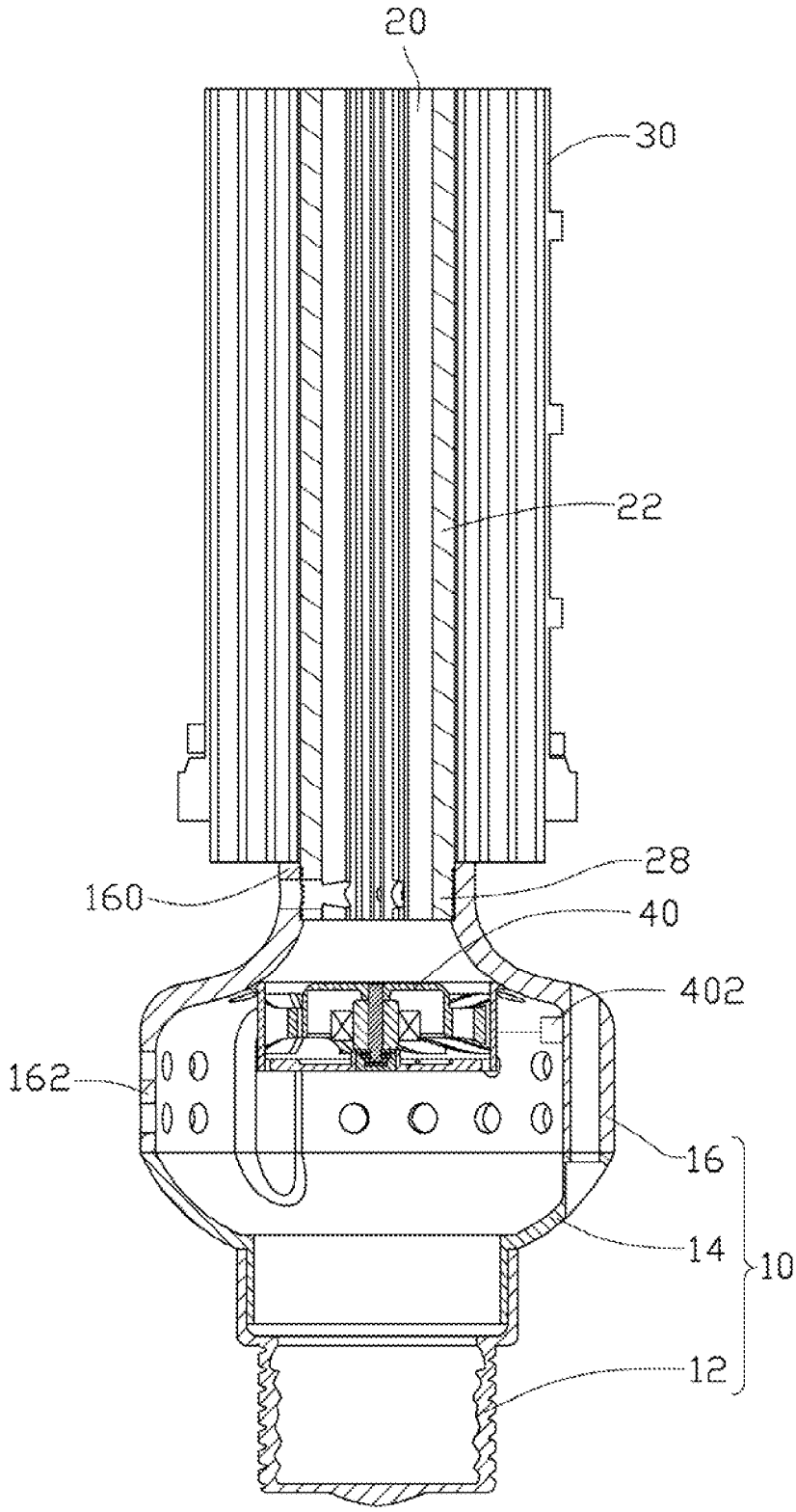
FIG. 4 is a cross-sectional view taken along line IV-IV of FIG. 1.

As shown in FIG. 4, the blower 40 is mounted in an upper portion of the second cover 16 and totally occupies an inlet from the inner space enclosed by the lamp base 10 to the through hole of the cylinder 22. The blower 40 can be constructed by different airflow generating apparatuses such a piezoelectric blower or an electrical motor-driven blower. Furthermore, a direction sensor 402 is provided in the LED lamp to detect a direction in which the LED lamp is placed so as to control the blower 40 to generate an upward airflow consistent with natural ventilation inside the LED lamp. The direction sensor 402 can be mounted in either the through hole of the heat sink 20 or the lamp base 10.

In assembly of the LED lamp, the blower 40 is secured to the upper portion of second cover 16 by adhering or screwing. The screws extend through the fixing orifices 1420 of the first cover 14 of the lamp base 10 to screw into the second cover 16 of the lamp base 10, whereby the first and second covers 14, 16 are thus assembled together. The heat sink 20 is mounted to the second cover 16 of the lamp base 10 by screwing the fixing part 28 at the bottom of the heat sink 20 downwardly into the engaging portion 160 of the second cover 16, thus heat sink 20 and the lamp base 10 are connected together. The through hole of the cylinder 22 communicates with the lamp base 10 and further communicates with ambient air through the vents 166 of the second cover 16. The LED modules 30 are respectively attached to the outer faces of the outermost second fins 260 of the heat sink 20 in a thermal conductive relationship.

Figure 5:
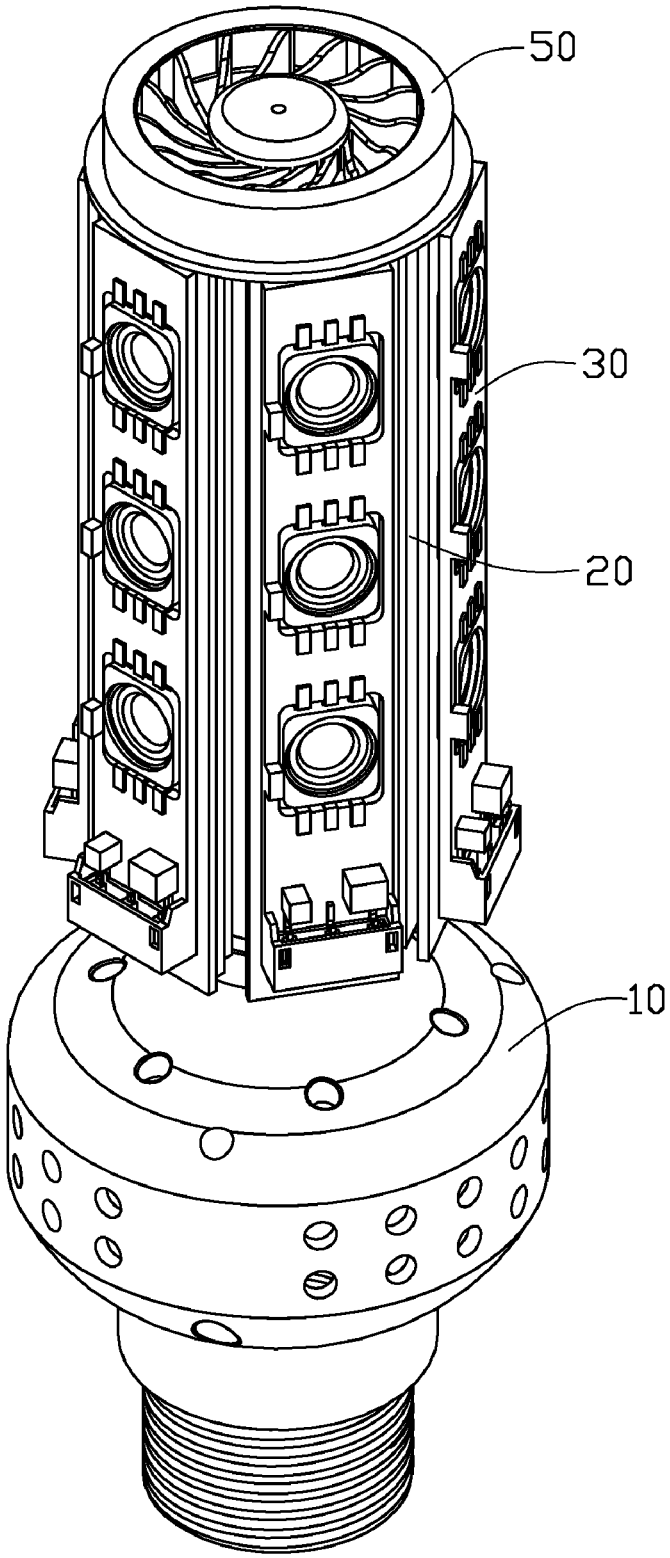
FIG. 5 is an isometric, assembled view of an LED lamp in accordance with another preferred embodiment of the present invention.

A preferred embodiment of the LED lamp having a heat dissipating structure according to the present invention has thus been described; however, it should be understood that the present invention is not limited to above. For example, an alternative embodiment is shown in FIG. 5, in which a blower 50 is mounted on a top of the heat sink 20 for blowing airflow into or drawing airflow from the through hole of the cylinder 22 of the heat sink 20. The blower 50 comprises a frame (not labeled) fitting on the top of the heat sink 20 and totally covers the top of the heat sink 20.

In use of the LED lamp, the space enclosed by the first and second cover 14, 16 and the through hole in the cylinder 22 of the heat sink 20 communicate with each other and cooperate to form an air passage in the LED lamp. Ambient air can flow into the air passage in the LED lamp through the vents 166 of the first cover 14 of the LED base 10 and exit the air passage from the top of the cylinder 22 of the heat sink 20; thus, an air circulation can be formed between an inside and an outside of the LED lamp. Alternatively, ambient air also can enter into the air passage through the top of the cylinder 22 and exit therefrom via the vents 166. An air circulation air circulates between the air passage in the LED lamp and ambient outside around the LED lamp is thus formed. Such an air circulation is greatly promoted by the blower 40, 50. When the LED modules 30 are activated, heat generated by the LED components 34 is adsorbed by the outmost second fins 260 of the heat sink 20 and then evenly distributed to the whole heat sink 20 via the conducting arms 26 of the heat sink 20. The heat of the heat sink 20 is finally removed by airflow circulating though the air passage.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a lamp base defining a plurality of vents therein;

a heat sink comprising a cylinder at a center thereof, the cylinder having a through hole therein, which communicates with the vents of the lamp base and cooperates with the vents to form an air passage;

a plurality of LED modules attached to a periphery of the heat sink;

a blower generating an airflow circulating through the air passage; and a direction sensor mounted in the lamp base or the heat sink, the direction sensor being configured for detecting a direction in which the LED lamp is placed so as to control the blower to generate an upward airflow consistent with natural ventilation inside the LED lamp.

2. The LED lamp of claim 1, wherein the blower is mounted in the lamp base, being located in the air passage and between the through hole and the vents.

3. The LED lamp of claim 1, wherein the blower is mounted at a top of the cylinder.

4. The LED lamp of claim 1, wherein a ratio of a length to a diameter of the cylinder is in a range from 5:1 to 10:1.

5. The LED lamp of claim 1, wherein the blower is one of a piezoelectric blower and an electrical motor-driven blower.

6. The LED lamp of claim 1, wherein the cylinder has a plurality of first fins extending inwardly from an inner wall thereof and a plurality of second fins surrounding the cylinder.

7. The LED lamp of claim 6, wherein a thickness of each of the first fins decreases inwardly.

8. The LED lamp of claim 1, wherein the heat sink has a plurality of conducting arms extending outwardly from an outer wall of the cylinder, and the conducting arms are centrosymmetric relative to a central axis of the cylinder.

9. The LED lamp of claim 8, wherein the second fins are formed at two lateral sides of each of the conducting arms.

10. The LED lamp of claim 9, wherein the second fins of each of the conducting arms are perpendicular to and symmetrical to each other relative to a corresponding conducting arm, and the second fins at a lateral side of each of the conducting arms increase in length outwardly from the cylinder to a distal end of the corresponding conducting arm.

11. The LED lamp of claim 10, wherein the distal end of the corresponding conducting arm terminates in an inner face of an outmost second fin of the corresponding conducting arm, and an outer face of the outmost second fin is flat on which a corresponding LED module is mounted.

12. The LED lamp of claim 1, wherein the lamp base comprises a lamp holder, a first cover connecting with the lamp holder and a second cover facing toward and engaging with the first cover.

13. The LED lamp of claim 12, wherein the first and second covers cooperatively form an enclosure enclosing an inner space, the inner space communicating with the through hole of the heat sink.

14. The LED lamp of claim 13, wherein the enclosure connects with the lamp holder at one end thereof, forms an annular engaging portion threadedly engaging with the heat sink, and defines the vents in a middle thereof.

15. The LED lamp of claim 14, wherein the heat sink has a fixing part extending downwardly from a bottom of the cylinder thereof, and the fixing part threadedly engages in the engaging portion of the lamp base.

16. An LED lamp comprising:

a lamp base enclosing a space and defining a plurality of vents communicating surrounding air with the space;

a heat sink mounted on the lamp base, the heat sink defining a through hole in communication with the space enclosed by the lamp base and forming a plurality of fins surrounding the through hole;

a plurality of LED modules each mounted on a corresponding fin;

an air blower for generating a forced airflow flowing through the vents, the space enclosed by the lamp base and the through hole of the heat sink; and a direction sensor mounted in the lamp base or the heat sink, the direction sensor being configured for detecting a direction in which the LED lamp is placed so as to control the air blower to generate an upward airflow consistent with natural ventilation inside the LED lamp;

wherein the LED modules have a plurality of LED components for generating light.

17. The LED lamp of claim 16, wherein the air blower is mounted in the lamp base.

18. The LED lamp of claim 16, wherein the air blower is mounted on an end of the heat sink remote from the lamp base.

19. The LED lamp of claim 16, wherein the lamp base has a lamp holder adapted for engaging in a lamp socket.

* * * * *